United States Patent [19]

Itoh et al.

[11] 3,970,905

[45] July 20, 1976

[54] THIN WIRE TYPE OF ELECTRIC FIELD CURTAIN SYSTEM

[75] Inventors: Tsutomu Itoh, Tokyo; Munekazu Sakurai, Kitamoto; Masahiro Yamamoto, Chiba; Yasunari Okamoto, Tokyo, all of Japan

[73] Assignee: Onoda Cement Company, Ltd., Onoda, Japan

[22] Filed: July 3, 1975

[21] Appl. No.: 593,105

[30] Foreign Application Priority Data

July 10, 1974 Japan ..... 49-78224
July 10, 1974 Japan ..... 49-78225

[52] U.S. Cl. ..... 317/262 E; 98/115 SB; 15/1.5 R

[51] Int. Cl.[2] ..... B08B 7/00

[58] Field of Search ..... 317/2 R, 262 A, 262 AE; 98/115 SB; 15/1.5; 134/1

[56] References Cited

UNITED STATES PATENTS 3,778,678 12/1973 Masuda ..... 317/262 E UX
3,801,869 4/1974 Masuda ..... 317/3
3,872,361 3/1975 Masuda ..... 317/262 E

*Primary Examiner*—R. N. Envall, Jr.
*Attorney, Agent, or Firm*—Price, Heneveld, Huizenga & Cooper

[57] ABSTRACT

In an electric field curtain system, a plurality of linear electrodes are embedded in an insulator layer in parallel to each other along the surface of said insulator layer so that silent discharge forming curved electric lines of force which are outwardly convex may be produced on the surface of said insulator layer, the width of each of said plurality of linear electrodes is chosen equal to or less than 3 mm, and the interval between the respective linear electrodes is selected within a limited range, whereby every charged particle may be floated away from the surface of the insulator layer so as not remain on said surface.

8 Claims, 13 Drawing Figures

THIN WIRE TYPE OF ELECTRIC FIELD CURTAIN SYSTEM

Figure 1:
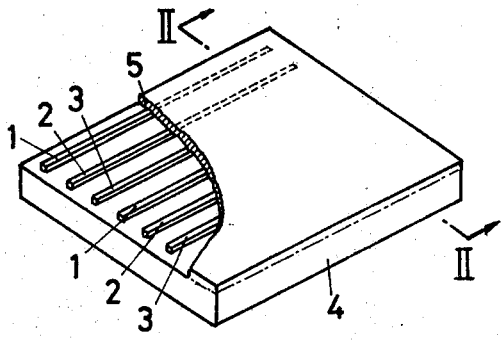

The present invention relates to improvements in a thin wire type of electric field curtain system for use in transportation, repulsion, confinement, brushing away, etc. of powder particles. More particularly, it relates to an electric field curtain system, in which a large number of parallel linear electrodes arrayed in parallel to each other are embedded in an insulator layer in the proximity of its surface at an equal interval, so that silent discharge forming curved electric lines of force which are outwardly convex may be produced on the surface of said insulator layer to remove charged particles away from said surface, and in which by selecting the physical configuration of said linear electrodes within a specific range, a continuous practical operation of said electric field curtain system is made possible and thereby an extremely excellent performance can be realized.

In case that a plurality of linear electrodes arrayed in parallel to each other at an equal interval are embedded in an insulator layer at a shallow portion near to its surface, every third one of said linear electrodes being connected in common and to each terminal of a three-phase A.C. voltage source to apply three-phase A.C. voltages across the respective linear electrodes, then in the space region near to the surface of the insulator layer are formed curved electric lines of force which are outwardly convex and thus charged particles existing within this space region are subjected to oscillation along these outwardly convex electric lines of force, so that the charged particles are subjected to repulsive forces directed outwardly from the surface of the insulator layer and thereby floated up. Also in this case, owing to a travelling A.C. electric field existing on the surface of the insulator layer, the powder particles are conveyed in a particular direction at right angles to the electrodes along the plane of the electrode array.

In case that this fine wire type of electric field curtain system is used as a lining of a booth, for example, for practicing electrostatic powder painting, it is believed principally possible to use the system for the purpose of collecting over-sprayed powder paint.

However, in the case of employing the aforementioned electric field curtain system as a lining of a powder painting booth for the purpose of carrying out color change of the powder paint, even if a very small amount of powder particles should deposit on the surface of the lining, it would become very difficult to carry out color change of the paint.

Heretofore, various industrially useful treatments by means of uneven alternating electric fields such as, for example, confinement, repulsion, brushing away, transportation, etc. of charged particles, have been proposed. However, these inventions in the prior art merely proved the possibility in principle, and it was definitely impossible to practically apply these inventions to the case where an extremely excellent performance is required as is the case with a lining of an electrostatic powder painting booth.

More particularly, in case that very intensely charged particles are contained as is the case with over-sprayed paint of an electrostatic powder painting apparatus, these particles would adhere strongly onto the surface of the insulator layer, and in order to brush away these particles it is necessary to apply such a high voltage that silent discharge may arise widely in the vicinity of the surface of the insulator layer. Still further, even if silent discharge should be caused to arise in the vicinity of the surface of the insulator layer, if the dimensions and structure of the electrodes are not yet appropriate, then mainly on the surface portions of the insulator layer right above the electrodes would remain unremovable powder deposits and also on the surface portions of the insulator layer at the midway between the electrodes would remain unremovable adhered powders. Therefore, even if the electric field curtain system was used as a lining of an electrostatic powder painting booth, it was impossible to carry out perfect color change, because these residual powder particles would gradually peel off the surface and would mix with the powder particles after the color change.

The above-mentioned difficulties quite similarly existed with respect to a thin wire type of electric field curtain system having an improved structure as described hereinunder. That is, the difficulties existed quite similarly with respect to the thin wire type of electric field curtain system, in which a plurality of parallel linear electrodes disposed in parallel to each other at an equal interval in the vicinity of an insulator layer are all connected in common, between these linear electrodes and a planar electrode embedded in the insulator layer at a depth from the surface deeper than said linear electrodes is applied an A.C. voltage by means of an A.C. voltage source, and thereby curved A.C. electric lines of force are produced between said respective linear electrodes and said planar electrode, which electric lines of force are outwardly convex at the surface of the insulator layer, whereby industrially useful operations such as repulsion, brushing away, transportation, etc. may be achieved with respect to charged particles existing in the space region in the vicinity of the surface of the insulator layer.

Therefore, it is a principal object of the present invention to provide an electric field curtain system having an extremely excellent performance, in which the aforementioned difficulties in the prior art have been eliminated, and which has such a performance that regardless of the nature of the powders and/or the amount of charge on the powders, the powders remaining on the surface of the electric field curtain system are practically negligible.

Also it is another object of the present invention to provide an electric field curtain system which is available not only for a lining of an electrostatic powder painting booth but also for other devices which require repulsion, transportation and/or brushing out of powder particles.

Still another object of the present invention is to provide an electric field curtain system which is free from the disadvantages in the prior art that even if a very small amount of remaining powder particles should exist on the surface of an electric field curtain system, these particles would solidify, adhere to the surface and change in nature during an unoperated period of the system, and thus would change the nature and/or configuration of the surface of the electric field curtain system, resulting in remarkable lowering of performance of the electric field curtain system after a relatively short period of use.

The inventors of this invention have made various investigations on the relations between the amount of remaining powders and the physical structures of the electric field curtain systems with respect to the abovedescribed two different types of electric field curtain systems, and as a result they have discovered an empirical law governing the relation between these quantities. Thus the inventors have invented an electric field curtain system having an extremely excellent performance characterized in that practically existence of a powder residue on the electric field curtain system would be obviated by applying the discovered law to the system.

According to one feature of the present invention, there is provided an electric field curtain system, in which a plurality of linear electrodes arranged in parallel to each other are embedded in an insulator layer along its surface, said system comprising means for generating silent discharge which forms outwardly convex curved electric lines of force on the surface of said insulator layer, the width of each of said plurality of linear electrodes being chosen equal to or less than 3 mm.

According to another feature of the present invention, there is provided the above-featured electric field curtain system, in which said curved electric lines of force are formed between the respective linear electrodes, and in which the ratio B/C of the interval B between the respective adjacent linear electrodes to the depth C of the linear electrodes as measured from the surface of the insulator layer is chosen in the range of 3 ~ 20, preferably 5 ~ 14.

According to still another feature of the present invention, there is provided the first-featured electric field curtain system, in which said curved electric lines of force are formed between the respective linear electrodes and a planar electrode embedded at a deeper portion than said linear electrodes as measured from the surface of the insulator layer, and in which the ratio B/D of the interval B between the respective adjacent linear electrodes to the distance D between said linear electrodes and said planar electrode is chosen in the range of 0.5 ~ 16, preferably 1.5 ~ 10.

Figure 2:
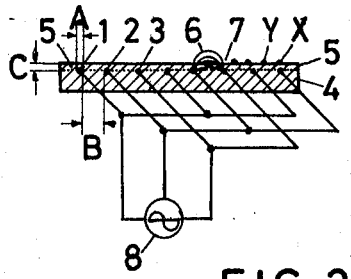
Figure 3:
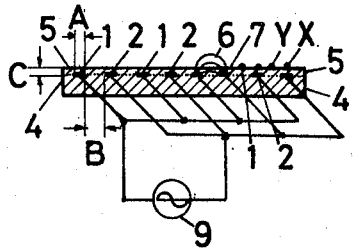
Figure 4:
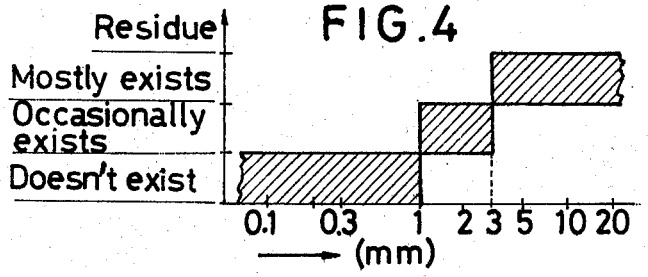
Figure 5:
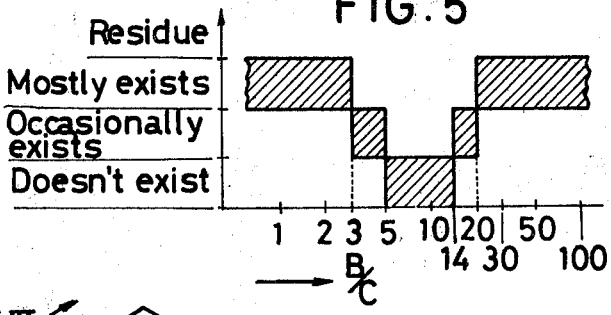
Figure 6:
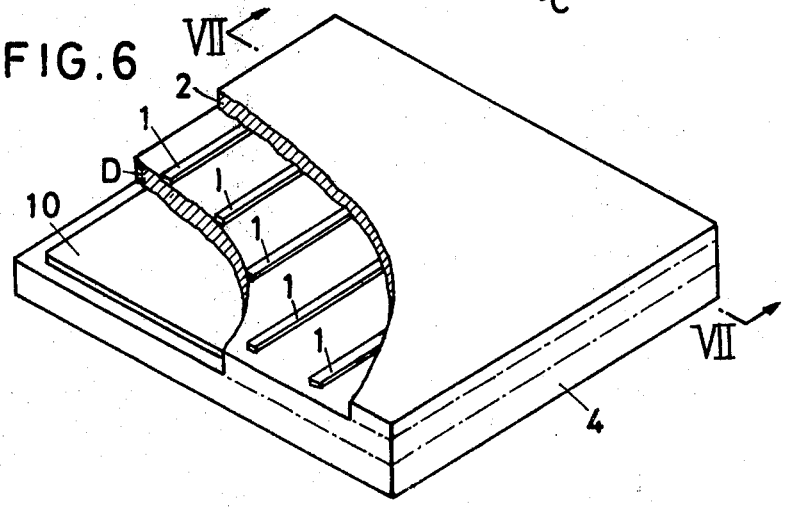
Figure 7:
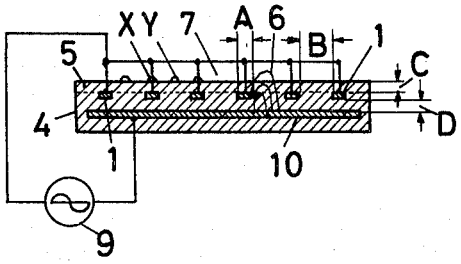
Figure 8:
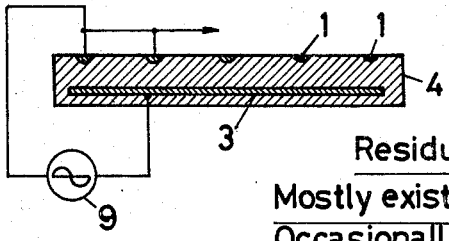
Figure 12:
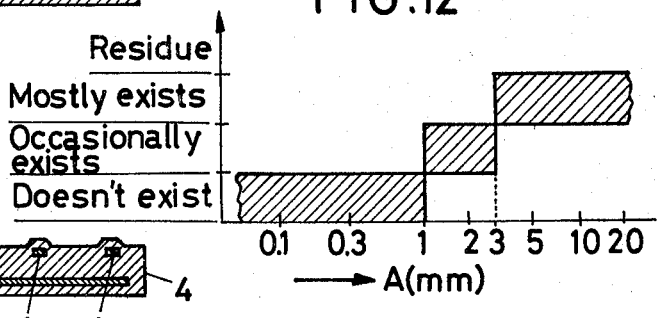
Figure 9:
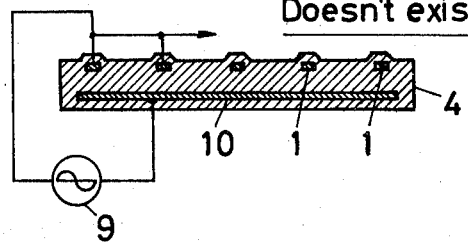
Figure 10:
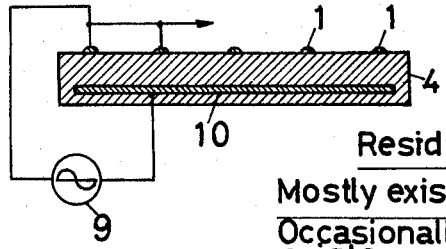
Figure 13:
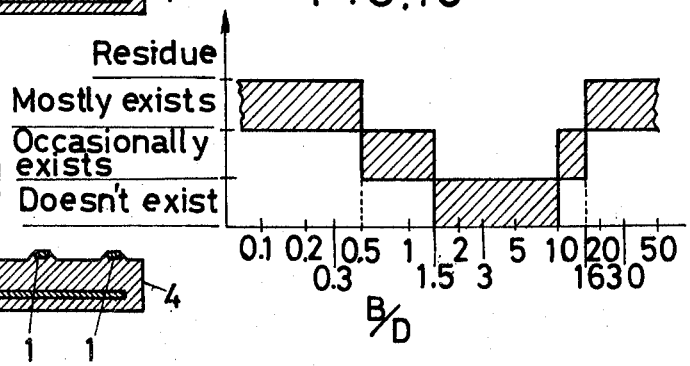
Figure 11:
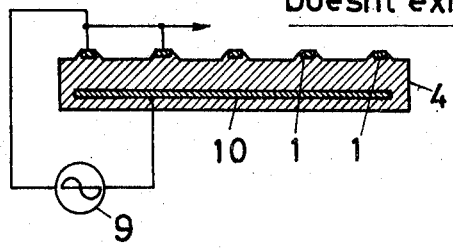

These and other features and objects of the present invention will be more fully understood from the following description taken in conjunction with the accompanying drawings, in which:

FIG. 1 is a perspective view partly cut away of a thin wire type of electric field curtain system of the kind in which electric lines of force are formed between respective adjacent linear electrodes, FIG. 2 is a cross-section view taken along line II—II in FIG. 1, FIG. 3 is a cross-section view similar to FIG. 2 of another embodiment of the present invention, FIG. 4 is a diagram showing an amount of residue as a function of a width of the linear electrode in connection to the embodiment shown in FIGS. 1 and 2, FIG. 5 is a diagram showing an amount of residue as a function of a parameter B/C in connection to the embodiment shown in FIGS. 1 and 2, FIG. 6 is a perspective view partly cut away of another preferred embodiment of the present invention, FIG. 7 is a cross-section view taken along line VII—VII in FIG. 6, FIGS. 8 through 11 are cross-section views similar to FIG. 7 of still further preferred embodiments, respectively, FIG. 12 is a diagram showing an amount of residue as a function of a width of the linear electrode in connection to the embodiment shown in FIGS. 6 and 7, and FIG. 13 is a diagram showing an amount of residue as a function of a parameter B/D in connection to the embodiment shown in FIGS. 6 and 7.

Referring now to FIGS. 1 and 2 of the drawings, reference numerals 1, 2 and 3 designate linear electrodes arrayed in a side-by-side relationship, numeral 4 designates a planar insulator layer whose surface layer is represented by numeral 5, numeral 6 designates curved electric lines of force which are formed between said electrodes 1, 2 and 3 and are outwardly convex, numeral 7 designates a space relation along the surface of the insulator layer, numeral 8 designates a three-phase A.C. voltage source, character A represents a width of each linear electrode 1, 2 or 3, character B represents a distance between the respective adjacent linear electrodes, character C represents the depth as measured from the surface of the insulator layer 4 to the linear electrodes 1, 2 and 3, that is, the thickness of the surface layer 5, character X designates powders remaining on the surface of the surface layer 5 right above the linear electrode, and character Y designates powders remaining at the midway between adjacent two linear electrodes.

With reference to FIG. 3, reference numeral 9 designates a single-phase A.C. voltage source, and reference numerals 1 ~ 7 and reference characters A, B, C, X and Y, respectively, represent the like component parts represented by similar reference numerals or characters in FIGS. 1 and 2.

In FIGS. 6 through 11, reference numeral 10 designates a planar electrode embedded within the insulator layer 4 as separated from the linear electrodes 1 by a distance D, and other reference numerals and characters 1 ~ 9, A, B, C, X and D represent the like component parts represented by similar reference numerals or characters in FIGS. 1 to 5.

A first characteristic feature of the highly excellent electrode field curtain system according to the present invention exists in that the width of each of the linear electrodes embedded in the insulator layer 4 in the vicinity of its surface is chosen equal to or less than 3 mm. More particularly, as will be apparent from FIGS. 4 and 12, the amount of the residual powders arising right above the electrode embedded in the vicinity of the surface as shown at X in FIGS. 2 and 7, decreases as the width of the electrode becomes narrower. That is, with respect to either powder paint for electrostatic powder painting such as polyethylene, polyester, epoxy, various fluorine resins, etc. or inorganic powders such as cement, lime, etc., if the width of the electrode is equal to or less than 1 mm, then normally the amount of the residual powders right above the electrode on the surface of the electric field curtain system is substantially zero. If the width of the electrode is in the range between 1 mm and 3 mm, then mostly the residual powders right above the electrode is negligible although in some cases the residual powders right above the electrode may exist depending upon the kind of the powders. However, if the width of the electrode exceeds 3 mm, then a considerable amount of residual powders remain on the surface right above the electrode with respect to most powders. Accordingly, the highly excellent electric field curtain system according to the present invention is characterized by the fact that the width A of the electrode is chosen equal to or less than 3 mm. As to the definition for "the width of the electrode," a width of an electrode appearing in a plan view of an electrode arrangement in an electric field curtain system could be employed.

A second characteristic feature of the highly excellent electric field curtain system according to the present invention, mainly relates to an interval between adjacent linear electrodes. In this case, the distance represented by character B in FIGS. 2 and 3 is called "an interval between linear electrodes disposed in the vicinity of the surface."

At first, in the highly excellent electric field curtain system according to the present invention, assuming that the thickness of the surface layer 5 in FIG. 2 is represented by C, the value of B/C is limited to within the range of 3 to 20. More particularly, with reference to FIG. 5, if B/C falls within the range of 5 to 14, then the existence of residual powders Y in the midway between the electrodes in FIG. 2 is practically of no matter with respect to the aforementioned various powders. While, if B/C falls within the range of 3 to 5 or 14 to 20, then occasionally the existence of residual powders Y on the surface of the electric field curtain system in the midway between the electrodes is observed depending upon the kind of the powders and the humidity of the atmosphere, although it cannot be observed in most cases. However, in case that B/C is either smaller than 3 or larger than 20, the existence of residual powders Y is remarkable, so that practically it is impossible to use the system for industrial purpose as an electric field curtain system. It is to be noted that the above-described performance of an electric field curtain system is a performance of an electric field curtain system with respect to powders of less than 100 microns in size when a sufficiently high voltage for assuring occurrence of silent discharge over the entire surface of the electric field curtain system has been applied to the system.

As described above, in an electric field curtain system in which a high voltage is applied to parallel electrodes disposed at an equal interval in the vicinity of a surface of an insulator layer 4 for carrying out industrially useful operations such as repulsion, confinement, transportation, brushing away, etc. of charged particles by means of outwardly convex curved A.C. electric lines of force 6 produced in the vicinity of the surface of the insulator layer; and in an electric field curtain system in which a sufficiently high voltage for assuring occurrence of silent discharge over the entire surface of an insulator layer 4 for carrying out industrially useful operations such as repulsion, confinement, transportation, brushing away, etc. of quite uncharged particles, little charged particles and appropriately charged particles; it is possible to make substantially no residual powders remain on the surface of the electric field curtain system at all when a sufficiently high voltage for assuring occurrence of silent discharge over the entire surface of the electric field curtain system, by selecting the width of the electrode equal to or less than 3 mm and, if possible to work, equal to or less than 1 mm, and in case of applying the voltage between adjacent electrodes, by selecting the value of B/C within the range of 5 to 14 if possible, and if it is impossible from some reasons, by selecting the value of B/C within the range of either 3 to 5 or 14 to 20.

While description has been made above with respect to the case where the electric field curtain system shown in FIGS. 1 and 2 is constructed in a plane form, the present invention is equally applicable to an electric field curtain system having a cylindrical surface, conical surface, spherical surface and any other curved surface, if desired. In addition, the parallel linear electrodes are not limited only to the rectilinear parallel wire form of electrodes, but the invention is equally applicable to the cases where linear electrodes having the shapes of a family of parallel curves or concentric circles, or other curved wire form of electrodes of any desired shape are utilized.

With regard to a voltage source, while description has been made above in connection to the case where three-phase alternating electric fields are applied, a single-phase alternating electric field is also equally useful for the purpose of repulsion, brushing away, confinement, etc. of charged particles although transportation capability is not produced, and in this case the parallel electrodes could be used by connecting every other ones in common. It is also a matter of course that alternating electric fields of more than three phases can be applied, and in such a case the parallel electrodes could be used by connecting every $(n-1)$th electrodes in common where $n$ represents the number of phases of the applied voltage source. The frequency of the voltage source could be within the range of 10 ~ 200 Hz, but normally the commercial frequency is available. The cross-section configuration of the linear electrodes used according to the present invention could be a circle, elongated circle, ellipse, rectangle or square, and further, linear electrodes having any other cross-section configuration could be used, if desired.

Now the invention will be explained in more detail in connection to the embodiment of the highly excellent electric field curtain system illustrated in FIGS. 1 to 3. In an electric field curtain system of the type shown in FIG. 2, in which voltages are applied between respective parallel linear electrodes 1, 2 and 3 disposed in the vicinity of the surface, the thickness C of the surface layer is chosen at 0.5 mm, the width A of the electrode is chosen at 0.5 mm, the interval B between the electrode is chosen at 5 mm, epoxy resin is selected as a material of the insulator layer 4, and a voltage of 8,000 V at 50 Hz is applied. Then with respect to any one of epoxy, polyester, vinyl fluoride, polyethylene, lime stone powder, cement powder and quick lime powder, powders substantially remaining on the surface of the electric field curtain system are not observed at all.

In this case, the value of B/C is equal to 10. Whereas, with the same electrode width, if the value of B/C is increased to 20 or if the value of B/C is decreased to 5, then with respect to a certain kind of polyethylene and cement, under the same voltage condition the residual powders are scarcely observed, while with respect to polyester, epoxy resin and the like some residual powders are observed. Furthermore, under the same voltage condition, if the value of B/C is decreased to 3 or if the value of B/C is increased to 35, then despite of the fact that an electric field curtain effect exists, with respect to almost all powders, a considerable amount of powders are observed on the electric field curtain system.

In the above-described examples, with respect to the electric field curtain system that is outside of the scope of the present invention, although some improvements in performance can be observed by raising the applied voltage, in this case the life of the system is so much shortened by the rise of the applied voltage that it becomes substantially impossible to practically use the electric field curtain system for various industrially useful operations.

On the other hand, in the case of the embodiments of the type illustrated in FIGS.. 6 to 11, the electric field curtain system according to the present invention is limited to the systems in which the value of B/D is larger than 0.5 and smaller than 16, where B represents the width of the linear electrode disposed in the vicinity of the surface of the electric field curtain system and D represents the distance between the plane of the linear electrode array and the planer electrode as shown in FIG. 7.

More particularly, with reference to FIG. 13, if B/D is within the range of 1.5 to 10, then the existence of residual powders Y on the surface between the electrodes as seen in FIG. 7 is practically of no matter with respect to every kind of powders. On the other hand, if B/D falls within the range of 0.5 to 1.5 or 10 to 16, then occasionally the residual powders Y existing on the surface of the electric field curtain system in the midway between the linear electrodes, are observed depending upon the kind of powders and the humidity in the atmosphere, although they cannot observed in most cases.

However, if B/D is further decreased to less than 0.5 or if it is further increased to larger than 16, then in either case existence of the residual powders Y is remarkable, and the practical usefulness of the electric field curtain system cannot be acknowledged. It is to be noted that the aforementioned performance of the electric field curtain system is a performance of an electric field curtain system when a sufficiently high voltage for assuring occurrence of silent discharge over the enter surface of the system is applied.

As described above, in an electric field curtain system in which a high voltage is applied to parallel electrodes disposed at an equal interval in the vicinity of a surface of an insulator layer 4 for carrying out industrially useful operations such as repulsion, confinement, transportation, brushing away, etc. of charged particles by means of outwardly convex curved A.C. electric lines of force 6 produced in the vicinity of the surface of the insulator layer; and in an electric field curtain system in which a sufficiently high voltage for assuring occurrence of silent discharge over the entire surface of an insulator layer 4 for industrially useful operations such as repulsion, confinement, transportation, brushing away, etc. of quite uncharged particles, little charged particles and appropriately charged particles, it is possible to make substantially no residual powders remain on the surface of the electric field curtain system at all when a sufficiently high voltage for assuring occurrence of silent discharge over the entire surface of the electric field curtain system, by selecting the width of the electrode equal to or less than 3 mm, and if possible to work, equal to or less than 1 mm, and in case of applying an A.C. high voltage between parallel linear electrodes which are all connected in common and a planar electrode 3 which is embedded at a deeper portion in the insulator layer, by selecting the value of B/D within the range of 1.5 to 10 if possible, and if it is impossible from some reasons, by selecting the value of B/D within the range of either 0.5 to 1.5 or 10 to 16.

While description has been made above with respect to the case where the electric field curtain system shown in FIGS. 6 and 7 is constructed in a plane form, the present invention is equally applicable to an electric field curtain system having a cylindrical surface, conical surface, spherical surface and any other curved surface, if desired. In addition, the parallel linear electrodes 1 are not limited only to the rectilinear parallel wire form of electrodes, but the invention is equally applicable to the cases where linear electrodes having the shapes of a family of parallel curves or concentric circles, or other curved wire form of electrodes of any desired shape are utilized. With regard to the voltage source, any A.C. voltage source having a frequency within the range of 10 to 100 Hz could be used, and normally the commercial frequency is available.

The cross-section configuration of the linear electrodes used according to the present invention could be a circle, elongated circle, ellipse, rectangle or square, and further, linear electrodes having any other cross-section configuration could be used, if desired.

Now the invention will be described in more detail in connection to the embodiment illustrated in FIGS. 6 and 7. In an electric field curtain system of the type shown in FIGS. 6 and 7, in which an A.C. high voltage is applied between parallel linear electrodes 1 and a planar electrode 10 disposed at a deeper portion in an insulator layer, the width A of the electrode is chosen at 0.5 mm, the distance D between the plane of the linear electrode array and the planar electrode 10 is chosen at 0.5 mm, and the interval B between the linear electrodes 1 is chosen at 5 mm. When a voltage of 6,000 V was applied between the linear electrodes 1 and the planar electrode 10, with respect to powders of polyethylene, polyester, epoxy, nylon, cement, quick lime, slaked lime, lime stone, etc., the performance of the electric field curtain system acting upon the powders supplied thereto was very excellent, and substantially no residual powder was observed on the electric field curtain system. However, if the value of B/D is selected at 13 or if the value of B/D is selected at 1, then under the same voltage condition, with respect to a certain kind of powders or in case of high humidity in the atmosphere, some residual powders are detected. Furthermore, if the value of B/D is selected at 0.3 or at 25, then despite of the fact that an electric field curtain effect can be observed, a considerable amount of powders are found on the electric field curtain system.

In the above-described examples, with respect to the electric field curtain system that is outside of the scope of the present invention, although some improvements in performance can be observed by raising the applied voltage, in this case the life of the system is so much shortened by the rise of the applied voltage that it becomes substantially impossible to practically use the electric field curtain system for various industrially useful operations.

What is claimed is:

1. A thin wire type of electric field curtain system including a plurality of linear electrodes embedded in an insulator layer in parallel to each other along the surface of said insulator layer wherein said system comprises silent discharge means including power supply means coupled to said linear electrodes for providing curved electric lines of force which extend outwardly in a convex pattern from the surface of said insulator layer, and wherein the width of each of said plurality of linear electrodes is chosen equal to or less than 3 mm.

2. A thin wire type of electric field curtain system as claimed in claim 1, further characterized in that said power supply means applies three-phase A.C. voltages across adjacent linear electrodes.

3. A thin wire type of electric field curtain system as claimed in claim 1, further characterized in that said power supply means applies a single-phase A.C. voltage across adjacent linear electrodes.

4. A thin wire type of electric field curtain system as claimed in claim 1, further characterized in that said silent discharge means includes a planar electrode disposed in parallel to the plane on which said linear electrodes are arrayed and insulated from said linear electrodes, and said power supply means applies an A.C. voltage across said linear electrodes and said planar electrode.

5. An electric field curtain system, in which a plurality of linear electrodes arrayed in parallel to each other are embedded in an insulator layer having a flat surface along said flat surface at a substantially fixed depth C and at substantially equal intervals B, and A.C. high voltage source coupled across adjacent electrodes so that a silent discharge is produced in the gas along the surface of said insulator layer, characterized in that the width of each of said linear electrodes is equal to or less than 3 mm,, and the ratio B/C of said equal interval B to said depth C is chosen in the range 3 – 30.

6. An electric field curtain system, in which a plurality of linear electrodes arrayed in parallel to each other are embedded in an insulator layer at or near its surface so as to maintain flatness of the surface layer at substantially equal intervals B, and in which there is provided a planar electrode spaced from said surface of the insulator layer and substantially in parallel to said surface of said insulator layer at a fixed distance D from said linear electrodes, an A.C. high voltage source coupled across adjacent linear electrodes so that a silent discharge is produced in the gas along said surface of said insulator layer, characterized in that the width of each of said linear electrodes is equal to or less than 3 mm, and the ratio B/D of said equal interval B to said fixed distance D is chosen in the range of 0.5 – 16.

7. The system as defined in claim 5 wherein the ratio B/C is within the range of 5 – 15.

8. The system as defined in claim 6 wherein the ratio B/D is within the range of 1.5 – 10.

* * * * *

UNITED STATES PATENT AND TRADEMARK OFFICE

CERTIFICATE OF CORRECTION

PATENT NO. : 3,970,905

DATED : July 20, 1976

INVENTOR(S) : Tsutomu Itoh et al.

It is certified that error appears in the above-identified patent and that said Letters Patent are hereby corrected as shown below:

Column 4, line 39:

"electrode" should be --- electric ---.

Column 8, line 10:

"100" should be --- 200 ---.

Signed and Sealed this

Second Day of November 1976

[SEAL]

*Attest:*

RUTH C. MASON
*Attesting Officer*

C. MARSHALL DANN
*Commissioner of Patents and Trademarks*